US011203830B2

(12) United States Patent
Wang et al.

(10) Patent No.: US 11,203,830 B2
(45) Date of Patent: Dec. 21, 2021

(54) DELIVERY DEVICE FOR WASHING MACHINE AND WASHING MACHINE HAVING SAME

(71) Applicant: WUXI LITTLE SWAN ELECTRIC CO., LTD., Wuxi (CN)

(72) Inventors: Haifeng Wang, Wuxi (CN); Chanwi Park, Wuxi (CN); Fei Peng, Wuxi (CN); Wei Zhou, Wuxi (CN); Yihua Zhou, Wuxi (CN); Lei Fan, Wuxi (CN); Haixu Jiang, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 82 days.

(21) Appl. No.: 16/541,023

(22) Filed: Aug. 14, 2019

(65) Prior Publication Data

US 2019/0368110 A1 Dec. 5, 2019

Related U.S. Application Data

(63) Continuation of application No. PCT/CN2017/086708, filed on May 31, 2017.

(30) Foreign Application Priority Data

Feb. 20, 2017 (CN) ..... 201710090547.9

(51) Int. Cl.
*D06F 39/02* (2006.01)
*D06F 39/08* (2006.01)

(52) U.S. Cl.
CPC ..... *D06F 39/022* (2013.01); *D06F 39/088* (2013.01)

(58) Field of Classification Search
CPC .... D06F 39/022; D06F 39/08; D06F 2204/08; D06F 39/02; D06F 39/028; D06F 39/088
(Continued)

(56) References Cited

U.S. PATENT DOCUMENTS 7,481,082 B2 * 1/2009 Cho ..... D06F 39/02 68/17 R
7,770,418 B2 * 8/2010 Kramme ..... D06F 39/022 68/17 R (Continued)

FOREIGN PATENT DOCUMENTS

CN 102421958 A 4/2012
CN 102741472 A 10/2012

(Continued)

OTHER PUBLICATIONS

XU et al., "Automatic placing-in system of washing machine and washing machine with same" Sep. 2016, CN-105937145-A—Machine Translation (Year: 2016).*

(Continued)

*Primary Examiner* — David G Cormier
*Assistant Examiner* — Thomas Bucci
(74) *Attorney, Agent, or Firm* — Morgan, Lewis & Bockius LLP

(57) ABSTRACT

A delivery device includes: a detergent container having a flow space and a withdrawal space, the flow space having a first inlet, a second inlet, a water inlet and a liquid outlet; a dispenser provided in the withdrawal space and capable of being pushed into and pulled out of the withdrawal space, the dispenser having two placing cavities spaced apart from each other, and each placing cavity having a delivery opening and a liquid discharge channel; and a pump having two inflow openings and two outflow openings. The two inflow openings are connected with the two liquid discharge channels respectively. The two outflow openings are connected with the first inlet and the second inlet respectively.

13 Claims, 10 Drawing Sheets

(58) Field of Classification Search
USPC ..... 68/17 R, 12.18, 13 R, 200, 12.19; 222/173, 1, 630, 416, 129
See application file for complete search history.

(56) References Cited

U.S. PATENT DOCUMENTS 9,057,150 B2* 6/2015 Zattin ..... D06F 39/02
2005/0229652 A1* 10/2005 Kim ..... D06F 39/028 68/237
2006/0162392 A1* 7/2006 Kwon ..... D06F 39/02 68/17 R
2008/0072630 A1* 3/2008 Je ..... D06F 39/02 68/17 R
2008/0072632 A1* 3/2008 Je ..... D06F 39/02 68/17 R
2008/0078211 A1* 4/2008 Je ..... D06F 39/02 68/17 R
2009/0261697 A1* 10/2009 Hill ..... D06F 39/02 312/333
2012/0024021 A1* 2/2012 Seo ..... D06F 39/028 68/200
2012/0096901 A1* 4/2012 Zattin ..... D06F 39/022 68/13 R
2012/0096903 A1* 4/2012 Kim ..... D06F 39/022 68/17 R
2012/0159997 A1* 6/2012 Pos ..... D06F 39/022 68/13 R
2012/0167637 A1* 7/2012 Mun, II ..... D06F 39/12 68/13 R
2012/0291916 A1* 11/2012 Hwang ..... D06F 39/022 141/311 R
2012/0312841 A1* 12/2012 Hwang ..... D06F 39/022 222/251
2013/0047678 A1* 2/2013 Lee ..... D06F 39/028 68/13 R
2013/0174614 A1* 7/2013 Kim ..... D06F 39/028 68/17 R
2013/0312463 A1* 11/2013 Kim ..... D06F 39/022 68/17 R
2014/0137608 A1* 5/2014 Seikel ..... D06F 39/02 68/17 R
2014/0144191 A1* 5/2014 Back, II ..... G01R 27/00 68/17 R
2014/0159559 A1* 6/2014 Kim ..... D06F 39/02 312/319.1
2015/0114047 A1* 4/2015 Jung ..... D06F 39/028 68/17 R
2015/0128659 A1* 5/2015 Hwang ..... F16K 11/24 68/17 R
2016/0153133 A1* 6/2016 Pos ..... D06F 39/02 68/12.18
2016/0177491 A1* 6/2016 Da Pont ..... D06F 39/022 222/135
2016/0258106 A1* 9/2016 Kim ..... D06F 39/022
2016/0273150 A1* 9/2016 Pos ..... D06F 39/02
2016/0289883 A1* 10/2016 Lv ..... D06F 39/02
2017/0073875 A1* 3/2017 Seo ..... D06F 33/37
2017/0183807 A1* 6/2017 Cinello ..... D06F 39/028

FOREIGN PATENT DOCUMENTS

CN 203755037 U * 8/2014
CN 203755037 U 8/2014
CN 203782432 U 8/2014
CN 204000328 U * 12/2014
CN 204000328 U 12/2014
CN 104894813 A 9/2015
CN 105358757 A 2/2016
CN 205478230 U 8/2016
CN 105937145 A * 9/2016
CN 105937145 A 9/2016
CN 105940153 A 9/2016
CN 105951371 A 9/2016
CN 106637835 A 5/2017
EP 2003237 A1 12/2008

OTHER PUBLICATIONS

Li et al., "Storage component for washing machine and washing machine with storage compartment" Aug. 2014, CN-203755037-U—Machine Translation (Year: 2014).*
Wang, "Device with automatic detergent and softener adding function and washer applying device" Dec. 2014, CN-204000328-U—Machine Translation (Year: 2014).*
Wuxi Little Swan Company Limited, International Search Report and Written Opinion, PCT/CN2017/086708, dated Nov. 24, 2017, 18 pgs.
Wuxi Little, Notice of First Review Opinion, CN201710090547.9, dated Aug. 2, 2018, 16 pgs.

* cited by examiner

DELIVERY DEVICE FOR WASHING MACHINE AND WASHING MACHINE HAVING SAME

CROSS REFERENCE TO RELATED APPLICATIONS

This application is a continuation application of PCT/CN2017/086708, filed on May 31, 2017, which claims priority to Chinese Patent Application No. 201710090547.9, filed with the Chinese Patent Office on Feb. 20, 2017, all of which are incorporated by reference in their entirety.

FIELD

The present disclosure relates to a technical field of household appliances, and more particularly to a delivery device for a washing machine, and a washing machine having the same.

BACKGROUND

At present, with the rising requirement for intelligent and precise delivery of detergents, a delivery device for a washing machine in the related art has been more and more widely used. Thus, more attention will be paid to design research on the delivery device.

SUMMARY

The present disclosure seeks to solve at least one of the problems existing in the related art to at least some extent. Therefore, the present disclosure provides a delivery device for a washing machine, which can increase the storage capacity of liquid washing products, draw different types of liquid washing products simultaneously and deliver them individually, such that the delivery device is formed as an automatic delivery structure, improving user comfort.

The present disclosure further provides a washing machine including the above delivery device.

The delivery device according to embodiments of the present disclosure includes: a detergent container defining a flow space and a withdrawal space therein, the flow space having a first inlet, a second inlet, a water inlet, and a liquid outlet, and the liquid outlet being configured to be connected with a washtub of the washing machine; a dispenser disposed in the withdrawal space and capable of being pushed into and pulled out of the withdrawal space, and defining two placing cavities spaced apart from each other, each placing cavity having a delivery opening and a liquid discharge channel; and a pump including two inflow openings connected with two liquid discharge channels correspondingly, and two outflow openings connected with the first inlet and the second inlet respectively.

For the delivery device according to embodiments of the present disclosure, by defining the two placing cavities in the dispenser, and providing the pump having the two inflow openings and the two outflow openings, the storage capacity of the liquid washing products can be increased, and the simultaneous suction of different types of washing products and individual delivery thereof can be realized. In such a way the delivery device is formed as an automatic delivery structure, and the user comfort is improved.

According to some embodiments of the present disclosure, each liquid discharge channel is provided with a closure member, the closure member normally closes the liquid discharge channel, and the closure member is opened when each of the inflow openings and the corresponding liquid discharge channel cooperate to suck the liquid.

Specifically, the closure member includes an annular sealing member, a first valve body, and a first spring; the sealing member is disposed in the liquid discharge channel, and has an outer peripheral wall in contact with an inner wall of the liquid discharge channel; the first valve body is movably disposed in the liquid discharge channel and located inside the sealing member; the first spring has two ends abutting against an inner wall of the dispenser and the first valve body respectively, to normally push the first valve body to cooperate with the sealing member, so as to seal an internal space of the sealing member.

According to some embodiments of the present disclosure, the delivery device further includes a limiting device configured to limit withdrawal displacement of the dispenser.

Specifically, the limiting device includes a retaining hook, a hook seat, and a second spring; the hook seat is disposed in a groove of an outer peripheral wall of the dispenser and provided with a pressing hole and a protrusion hole; the retaining hook is disposed in the hook seat, is provided with a protrusion facing the protrusion hole, and has a part facing the pressing hole; the second spring has a first end abutting against the dispenser or the hook seat, and a second end abutting against the retaining hook to normally push the protrusion to extend out of the protrusion hole.

Further, when the second spring abuts against the dispenser, the groove has an inner wall provided with a positioning column configured to position the second spring.

According to some embodiments of the present disclosure, the dispenser further includes two delivery lids arranged corresponding to the two delivery openings to open or close the respective delivery openings.

According to some embodiments of the present disclosure, the flow space is provided with a unidirectional valve therein, and the unidirectional valve is arranged adjacent to the water inlet and configured to allow water to unidirectionally flow into the flow space through the water inlet.

Specifically, the unidirectional valve includes a second valve body and a third spring, and the third spring abuts against the second valve body and an inner wall of the water flow space to normally abut against the second valve body so as to close the water inlet.

According to some embodiments of the present disclosure, the detergent container includes an upper cover, a middle cover, and a lower cover; the lower cover defines the withdrawal space having an open top, and is provided with an overall outlet; the middle cover is disposed on top of the lower cover, the upper cover is disposed on top of the middle cover, and the upper cover and the middle cover define the flow space therebetween; the liquid outlet is connected with the overall outlet by a pipe.

According to some embodiments of the present disclosure, the dispenser includes a dispenser box body and a dispenser box lid; the dispenser box body defines the two placing cavities therein; the dispenser box lid is disposed on top of the dispenser box body and provided with the two delivery openings therein.

Further, the dispenser box lid is provided with a flow channel therein, and has a bottom wall provided with two extension pipes extending downwardly; the two extension pipes extend into the two placing cavities correspondingly, and together with the flow channel define the liquid discharge channels; the two inflow openings are connected to the dispenser box lid.

The washing machine according to embodiments of the present disclosure includes the above delivery device.

For the washing machine according to embodiments of the present disclosure, by providing the delivery device according to the above embodiments of the present disclosure, the storage capacity of the liquid washing products can be increased, and the simultaneous suction of different types of washing products and individual delivery thereof can be realized. In such a way, the delivery device is formed as an automatic delivery structure, and the user comfort is improved.

Figure 1:
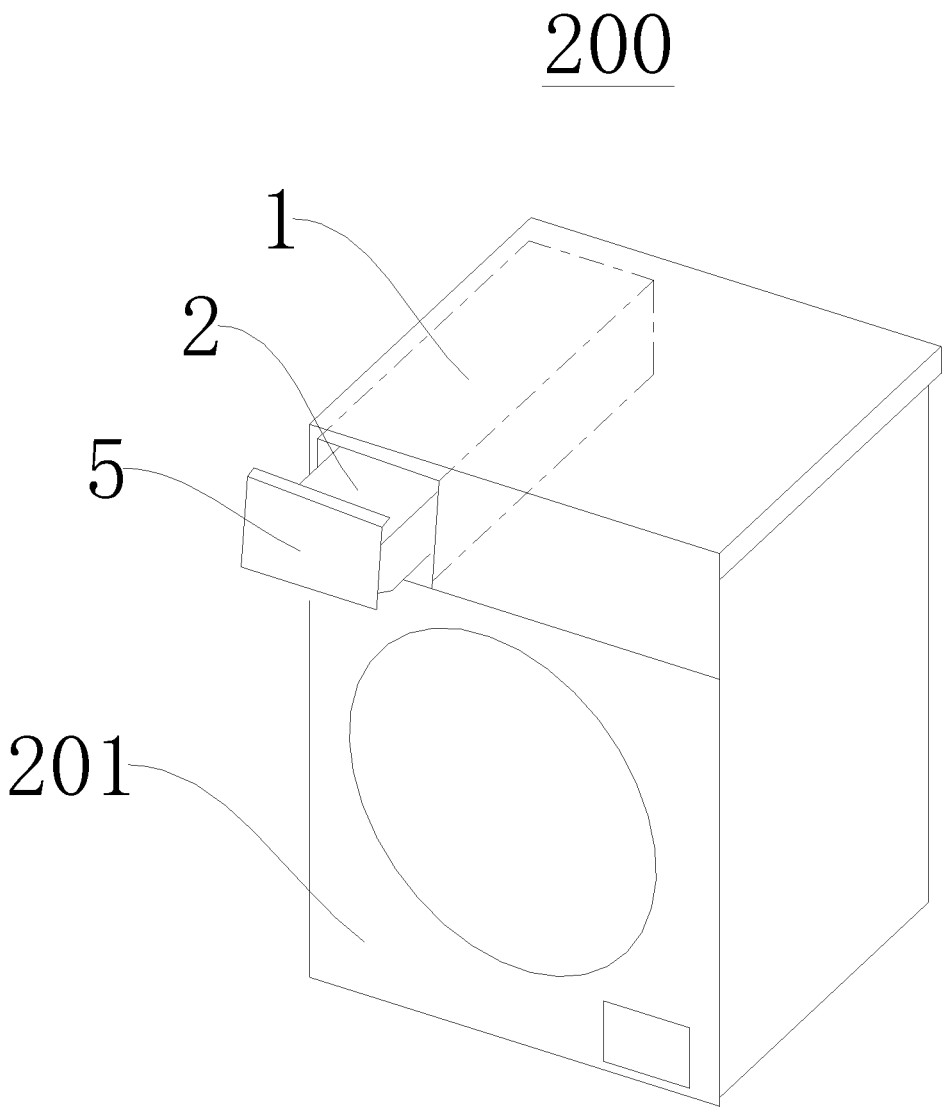
FIG. 1 illustrates a schematic view of a washing machine according to embodiments of the present disclosure.
Figure 2:
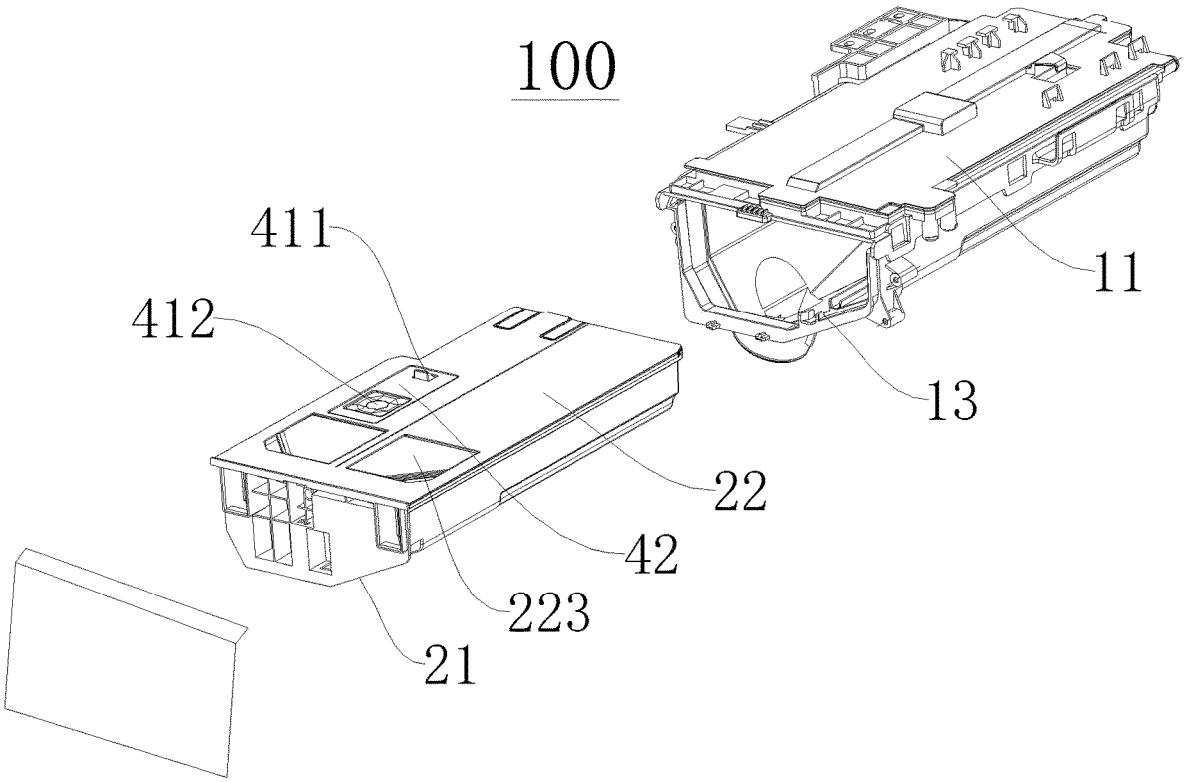
FIG. 2 illustrates a partially exploded view A of a delivery device according to embodiments of the present disclosure.
Figure 3:
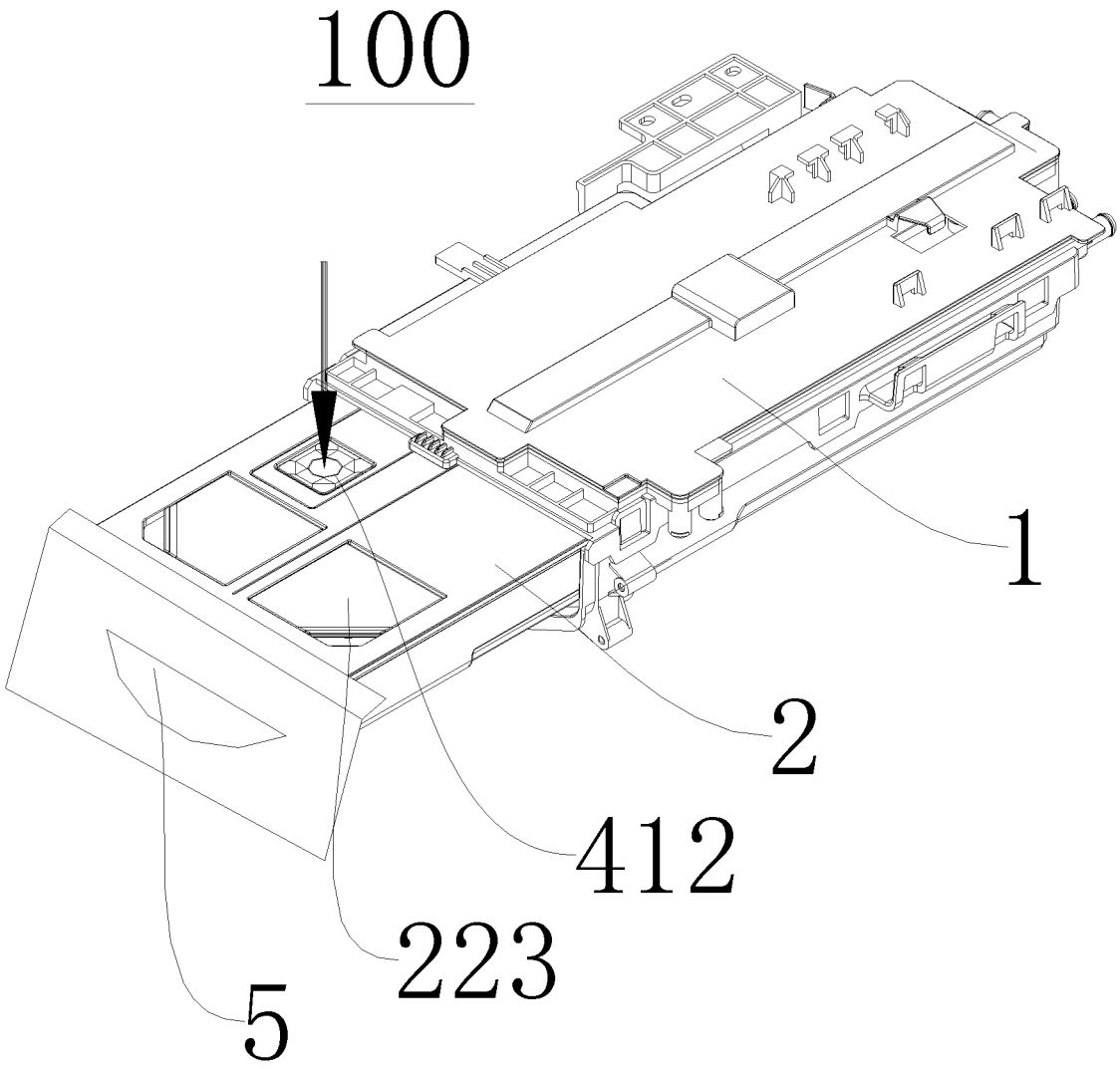
FIG. 3 illustrates a schematic view of a delivery device according to embodiments of the present disclosure, in which the delivery device is in a withdrawn state.
Figure 4:
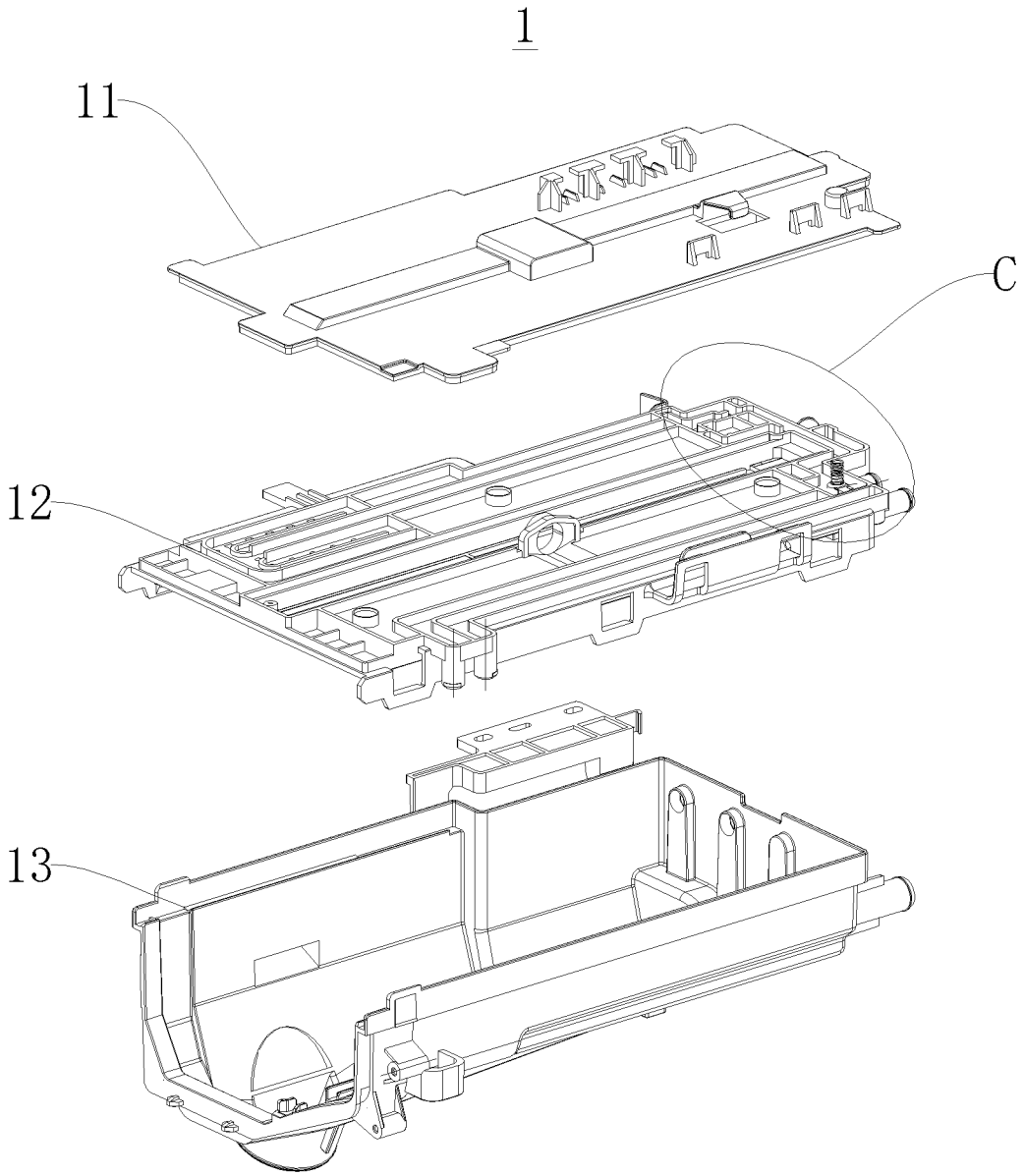
FIG. 4 illustrates a partially exploded view of a detergent container according to embodiments of the present disclosure.
Figure 5:
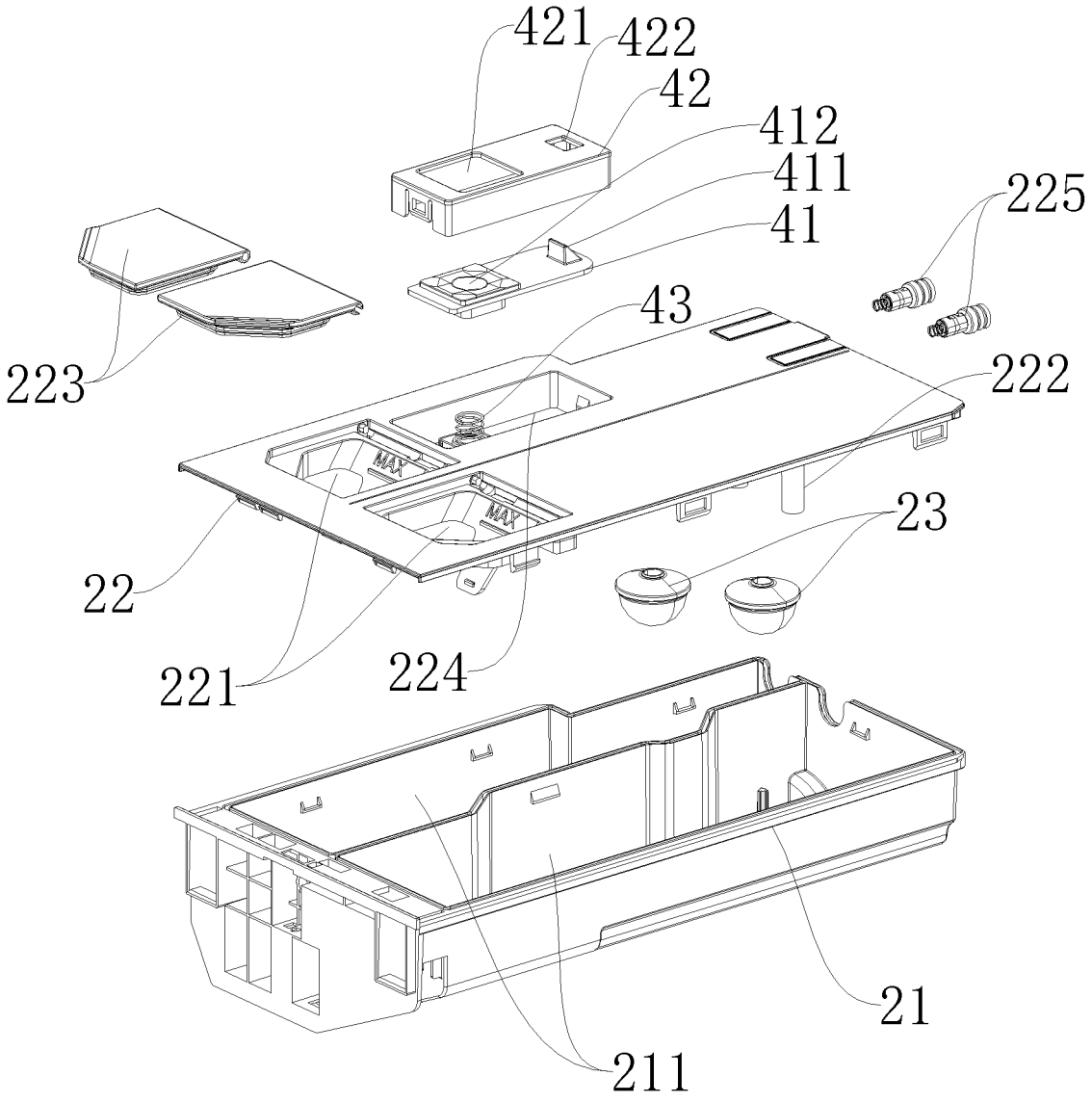
FIG. 5 illustrates an exploded view of a dispenser and a limiting device according to embodiments of the present disclosure.

REFERENCE NUMERALS delivery device 100, washing machine 200,
detergent container 1, upper cover 11, middle cover 12, first inlet 121, second inlet 122, water inlet 123, liquid outlet 124, unidirectional valve 125, second valve body 1251, third spring 1252, lower cover 13, water injection port 14,
dispenser 2, dispenser box body 21, placing cavity 211, dispenser box lid 22, delivery opening 221, extension pipe 222, delivery lid 223, groove 224, positioning column 2241, closure member 225, sealing member 2251, first valve body 2252, first spring 2253, floater 23,
pump 3, inflow opening 31, outflow opening 32,
limiting device 4, retaining hook 41, protrusion 411, pressing portion 412, hook seat 42, pressing hole 421, protrusion hole 422, second spring 43,
handle 5,
cabinet 201.

DETAILED DESCRIPTION

Embodiments of the present disclosure will be described in detail and examples of the embodiments will be illustrated in the drawings. The embodiments described herein with reference to drawings are explanatory, which are merely used to illustrate the present disclosure, but shall not be construed to limit the present disclosure.

In the specification, it is to be understood that terms such as "upper," "lower," "top," "bottom," "inner," "outer," and the like should be construed to refer to the orientation or position relationship as then described or as shown in the drawings under discussion. These relative terms are for convenience of description and do not indicate or imply that the present disclosure must have a particular orientation or be constructed and operated in a particular orientation. Thus, these relative terms should not be constructed to limit the present disclosure.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, the term "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections or mutual communication; may also be direct connections or indirect connections via intervening structures; may also be inner communications or mutual interaction of two elements, which can be understood by those skilled in the art according to specific situations.

A delivery device 100 for a washing machine 200 according to embodiments of the present disclosure will be described with reference to FIGS. 1-10. The delivery device 100 according to the present disclosure is configured to deliver a liquid washing product for cleaning clothes. Specifically, the liquid washing product may be a detergent, a softener, bleach, etc. In the following, the liquid washing product will be described by example of a detergent and a softener.

As illustrated in FIGS. 1-10, the delivery device 100 according to embodiments of the present disclosure includes a detergent container 1, a dispenser 2, and a pump 3.

Specifically, the detergent container 1 defines a flow space and a withdrawal space therein. The flow space has a first inlet 121, a second inlet 122, a water inlet 123, and a liquid outlet 124. The liquid outlet 124 is configured to be connected with a washtub (not illustrated) of the washing machine 200. It can thus be seen that a mixed liquid formed by mixing the washing product with water in the flow space flows into the washtub through the liquid outlet 124.

The dispenser 2 is disposed in the withdrawal space and is capable of being pushed into and pulled out of the withdrawal space. The dispenser 2 defines two placing cavities 211 spaced apart from each other. Each placing cavity 211 is provided with a delivery opening 221 and a liquid discharge channel. Thus, when the washing product needs to be delivered to the dispenser 2, the dispenser 2 is pulled out of the detergent container 1, and the user can deliver different types of washing products in the two placing cavities 211 by means of different delivery openings 221 respectively. Since the washing products in the two placing cavities 211 are liquid, the delivery device 100 according to embodiments of the present disclosure has no storage space for solid washing products, thereby increasing the storage capacity of detergents and softeners, compared with the related art.

The pump 3 includes two inflow openings 31 and two outflow openings 32. The two inflow openings 31 are connected with two liquid discharge channels correspondingly. The two outflow openings 32 are connected with the first inlet 121 and the second inlet 122 respectively. It can be known that the pump 3 can realize simultaneous suction of washing products from the two placing cavities 211, and deliver the different washing products to the flow space through the first inlet 121 and the second inlet 122 respectively, such that the mixed liquid formed by mixing the washing products with water flows into the washtub through the liquid outlet 124. Thus, the delivery device 100 is formed as an automatic delivery structure, improving user comfort.

In a specific example of the present disclosure, the pump 2 may be fixed in the withdrawal space, and when the dispenser 2 is pulled out of the withdrawal space, the dispenser 2 is separated from the pump 3. When the dispenser 2 is pushed into the withdrawal space, the dispenser 2 cooperates with the pump 3 to facilitate the suction of the washing products from the two placing cavities 211 by the pump 3.

For the delivery device 100 according to embodiments of the present disclosure, by defining the two placing cavities 211 in the dispenser 2, and providing the pump 3 having the two inflow openings 31 and the two outflow openings 32, the storage capacity of the liquid washing products can be increased, and the simultaneous suction of different types of liquid washing products and individual delivery thereof can be realized. In such a way, the delivery device 100 is formed as an automatic delivery structure, and the user comfort is improved.

Specifically, the detergent container 1 includes an upper cover 11, a middle cover 12, and a lower cover 13. The lower cover 13 defines the withdrawal space having an open top, and is provided with an overall outlet 127. The middle cover 12 is disposed on top of the lower cover 13, the upper cover 11 is disposed on top of the middle cover 12, and the upper cover 11 and the middle cover 12 define the flow space therebetween. The liquid outlet 124 is connected with the overall outlet 127 by a pipe 126. Therefore, the detergent container 1 may have a simple structure, and the mixed liquid formed by the detergent, the softener, and water can flow into the washtub smoothly without being influenced by the dispenser 2.

Further, the flow space is provided with a unidirectional valve 125 therein, and the unidirectional valve 125 is arranged adjacent to the water inlet 123 and configured to allow the water to unidirectionally flow into the flow space through the water inlet 123. Thus, it is possible to prevent the mixed liquid in the flow space from flowing back to a domestic waterway connected with the water inlet 123 through the water inlet 123 and from contaminating a water source, thereby improving the reliability of the delivery device 100.

Figure 10:
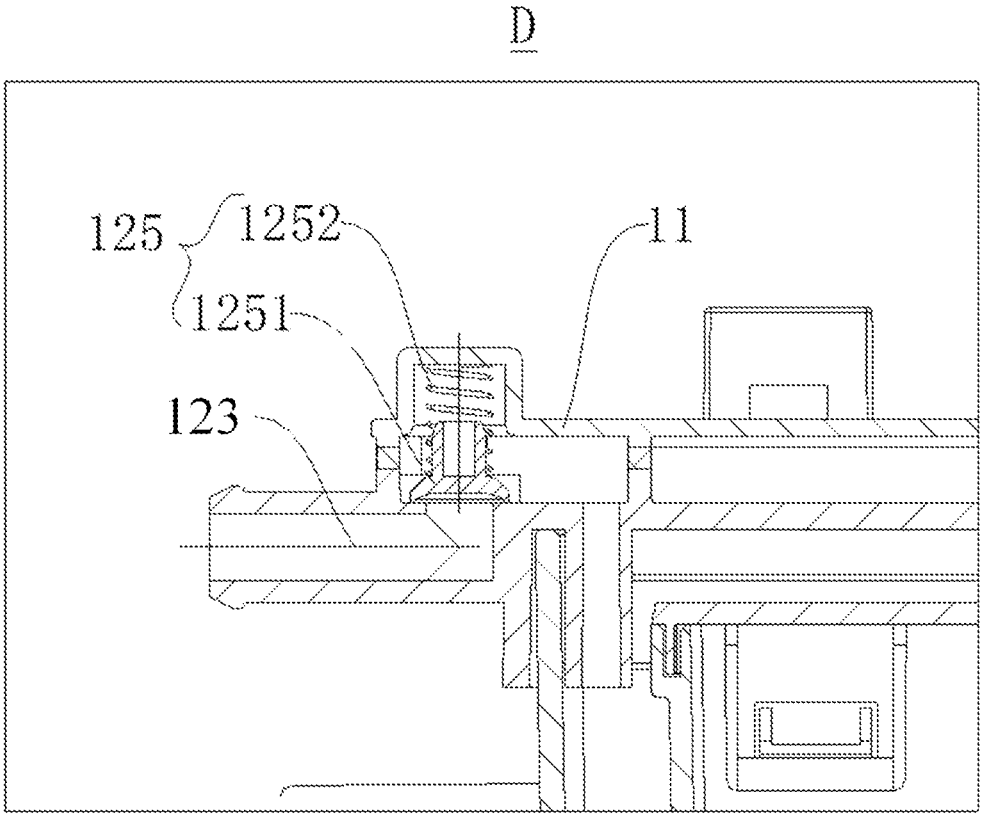
FIG. 10 illustrates a partially schematic view D of a delivery device according to embodiments of the present disclosure.

Specifically, as illustrated in FIG. 10, the unidirectional valve 125 includes a second valve body 1251 and a third spring 1252, and the third spring 1252 abuts against the second valve body 1251 and an inner wall of the water flow space to normally abut against the second valve body 1251 to close the water inlet 123. When the water flow enters the water inlet 123, since the water pressure is higher than the pressure of the third spring 1252 against the second valve body 1251, the water flow opens the second valve body 1251, in which case the water flow enters the flow space to be mixed with the detergent and the softener and then is discharged into the washtub through the liquid outlet 124. When the delivery device 100 does not need to deliver the detergent and the softener into the washtub, the water supply to the water inlet 123 is stopped, and at this time, the second valve body 1251 closes the water inlet 123 under the pressure of the third spring 1252, which prevents the mixed liquid in the flow space from flowing back to the domestic waterway through the water inlet 123 and from contaminating the water source, and hence improves the reliability of the delivery device 100.

According to some embodiments of the present disclosure, the dispenser 2 includes a dispenser box body 21 and a dispenser box lid 22. The dispenser box body 21 defines two placing cavities 211 therein. The dispenser box lid 22 is arranged on top of the dispenser box body 21, and provided with two delivery openings 221 therein. Thus, the dispenser 2 has a simple structure.

Further, the dispenser 2 also includes two delivery lids 223 arranged corresponding to the two delivery openings 221 to open or close the respective delivery openings 221. Thus, when it is desired to deliver the detergent and the softener into the dispenser 2, the user can open the delivery lids 223 to deliver the liquid. When there is no need to add the detergent and the softener to the dispenser 2, the delivery lids 223 are closed to avoid leakage, which is beneficial to improving the reliability of the delivery device 100.

Optionally, each placing cavity 211 is provided with a floater 23 therein. Thus, liquid levels of the detergent and the softener in the placing cavities 211 can be detected to determine whether it is necessary to add the detergent and the softener to the placing cavities 211, thereby ensuring a washing effect of the washing machine 200 and improving the comfort of the user.

Specifically, the dispenser box lid 22 is provided with a flow channel 226 therein, and the dispenser box lid 22 has a bottom wall provided with two extension pipes 222 extending downwardly. The two extension pipes 222 extend into the two placing cavities 211 correspondingly, and together with the flow channel 226 define the liquid discharge channels, and the two inflow openings 31 are connected to the dispenser box lid 22. Therefore, when the liquid needs to be sucked through the inflow openings 31 of the pump 3, the inflow openings 31 are communicated with the liquid discharge channels, and the liquids in the two placing cavities 211 enter the pump 3 through the two extension pipes 222, respectively.

According to some embodiments of the present disclosure, each liquid discharge channel is provided with a closure member 225 therein, the closure member 225 is configured to normally close the liquid discharge channel, and the closure member 225 is opened when the inflow opening 31 and the corresponding liquid discharge channel cooperate to suck the liquid. Thus, when the pump 3 sucks the liquid, the closure member 225 is opened to make it convenient for the inflow opening 31 to draw the liquid through the liquid discharge channel and deliver the liquid to the flow space. Meanwhile, the arrangement of the closure member 225 can also prevent the detergent and the softener from overflowing from the liquid discharge channel due to shaking and tilting after the dispenser 2 is completely withdrawn, so as to improve the reliability of the delivery device 100.

Figure 6:
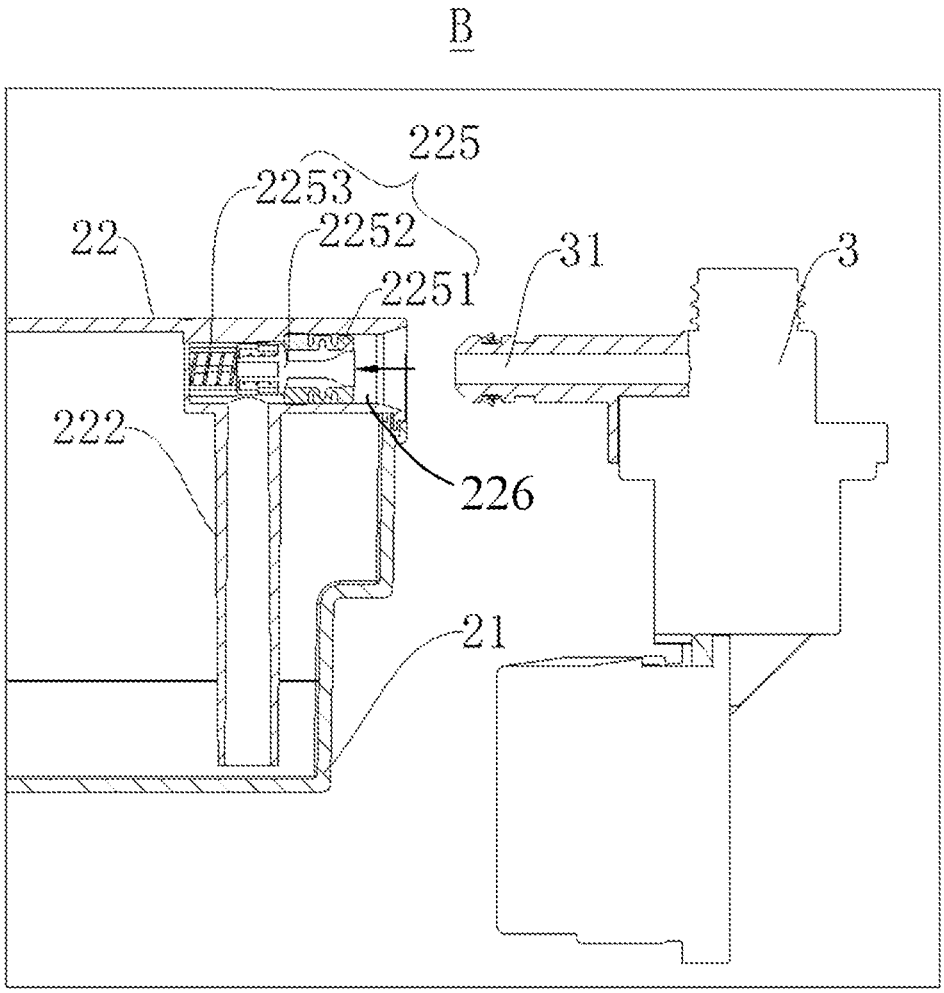
FIG. 6 illustrates a partially schematic view B of a delivery device according to embodiments of the present disclosure.
Figure 7:
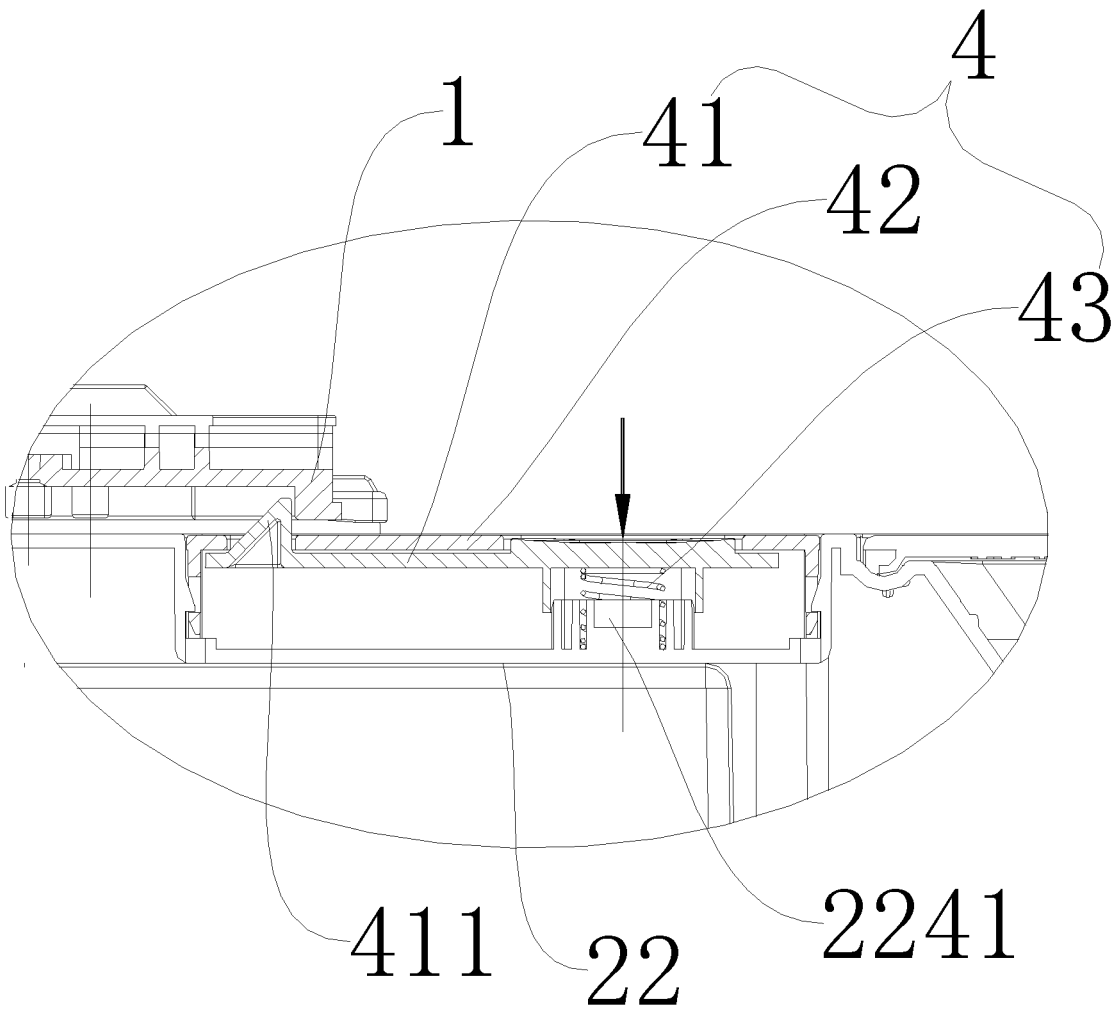
FIG. 7 illustrates a partially enlarged view of the delivery device in FIG. 3.
Figure 8:
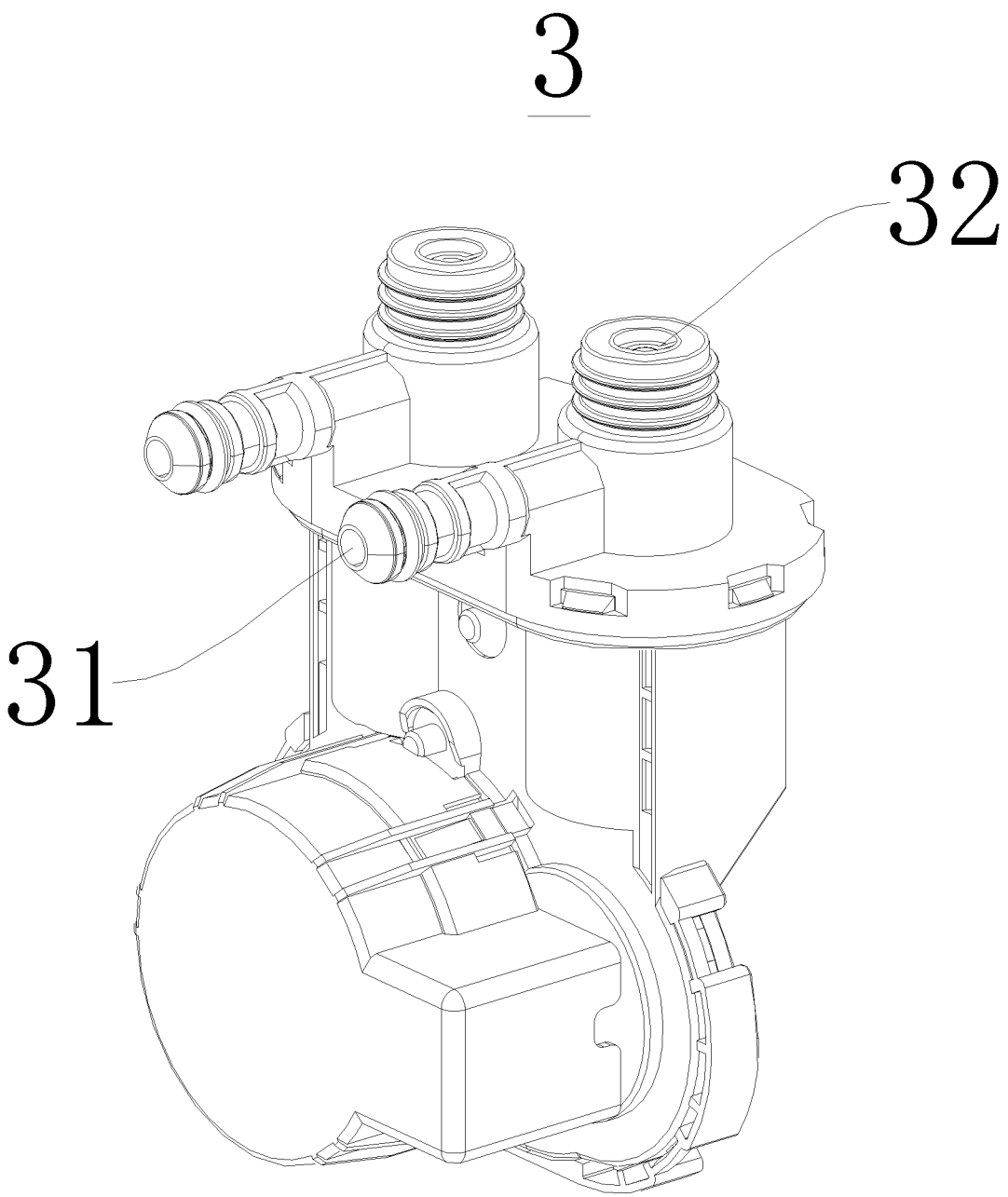
FIG. 8 illustrates a schematic view of a pump according to embodiments of the present disclosure.
Figure 9:
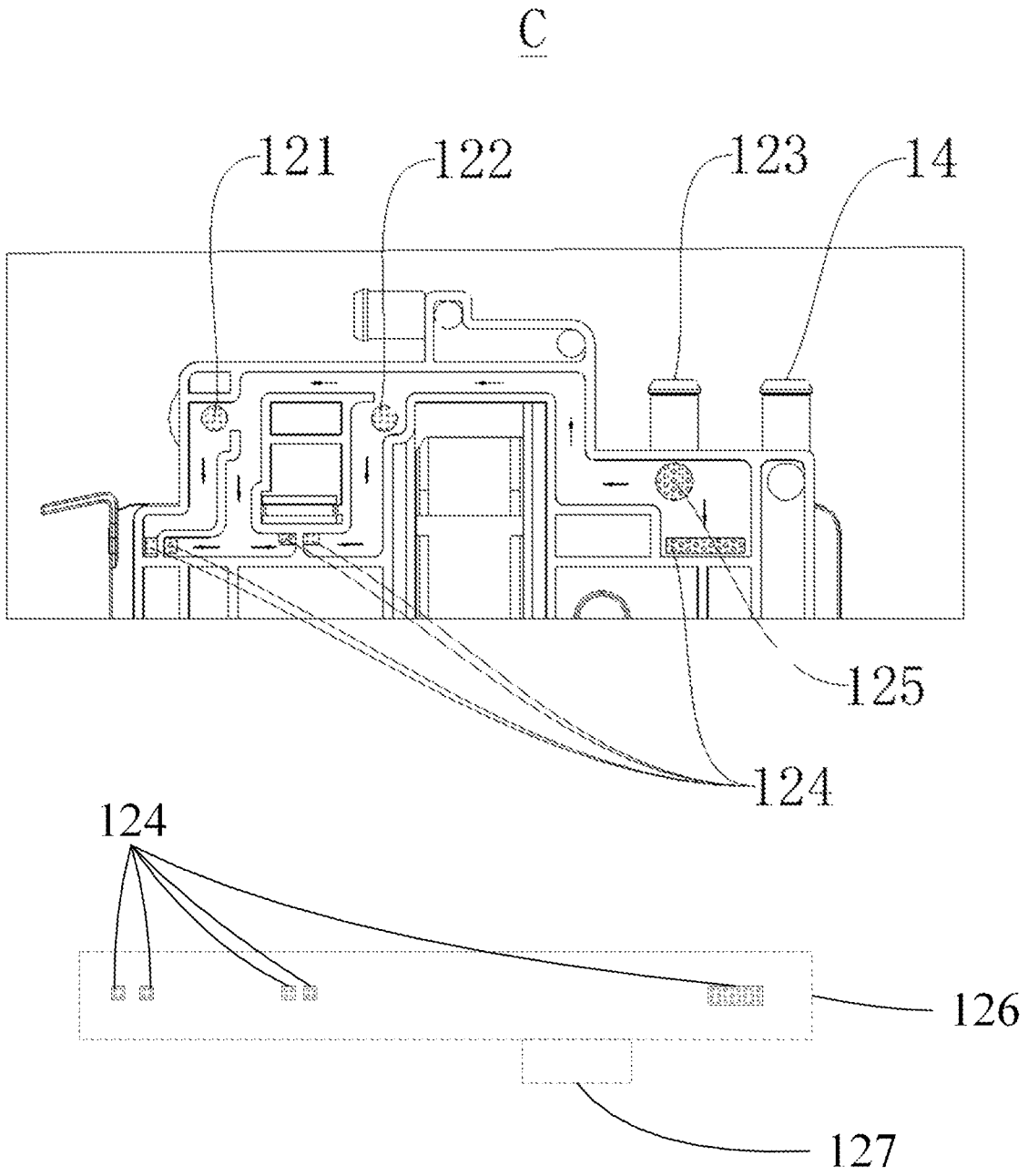
FIG. 9 illustrates an enlarged view of part C of the detergent container in FIG. 4.

Further, as illustrated in FIG. 6, the closure member 225 includes an annular sealing member 2251, a first valve body 2252, and a first spring 2253. The sealing member 2251 is disposed in the liquid discharge channel, and has an outer peripheral wall in contact with an inner wall of the liquid discharge channel. The first valve body 2252 is movably disposed in the liquid discharge channel and located inside the sealing member 2251. The first spring 2253 has two ends abutting against an inner wall of the dispenser 2 and the first valve body 2252 respectively, to normally push the first valve body 2252 to cooperate with the sealing member 2251, so as to seal an internal space of the sealing member 2251. Thus, the reliability of the closure member 225 can be enhanced, and the sealing performance of the closure member 225 can be improved by the arrangement of the sealing member 2251. When the dispenser 2 is completely placed in the detergent container 1, the inflow opening 31 of the pump 3 bears against the first valve body 2252, hence causes the first valve body 2252 to exert pressure on the first spring 2253, and the first spring 2253 is compressed under pressure, such that the inflow opening 31 passes through the sealing member 2251 to be communicated with the liquid discharge channel to realize the liquid suction by the pump 3. The direction indicated by the black arrow in FIG. 6 is the direction in which the inflow opening 31 of the pump 3 is inserted into the closure member 225 to be communicated with the liquid discharge passage when the dispenser 2 is completely placed in the detergent container 1.

According to some embodiments of the present disclosure, the delivery device 100 further includes a limiting device 4 configured to limit withdrawal displacement of the dispenser 2, thereby further ensuring the reliability of the delivery device 100 and avoiding excessive displacement of the dispenser 2 when the user withdraws the dispenser 2, which may result in inconvenience of restoring the dispenser 2.

Specifically, as illustrated in FIGS. 2, 3, 5 and 7, the limiting device 4 includes a retaining hook 41, a hook seat 42, and a second spring 43. The hook seat 42 is disposed in a groove 224 of an outer peripheral wall of the dispenser 2, and is provided with a pressing hole 421 and a protrusion hole 422. The retaining hook 41 is disposed in the hook seat 42, is provided with a protrusion 411 facing the protrusion hole 422, and has a part facing the pressing hole 421. The second spring 43 has a first end abutting against the dispenser 2 or the hook seat 42, and a second end abutting against the retaining hook 41 to normally push the protrusion 411 to extend out of the protrusion hole 422.

Specifically, when the user withdraws the dispenser 2 outwardly to deliver the washing product into the delivery opening 221, since the protrusion 411 on the retaining hook 41 protrudes out of the protrusion hole 422, the protrusion 411 of the retaining hook 41 will abut against an inner end face of a withdrawal port of the detergent container 1, thereby limiting the withdrawal displacement of the dispenser 2. When the dispenser 2 needs to be detached from the detergent container 1, the retaining hook 41 is pressed through the pressing hole 421, the second spring 43 is compressed, and the protrusion 411 is retracted into the protrusion hole 422, such that the limiting action of the protrusion 411 is released, and the dispenser 2 can be pulled out of the withdrawal space. Likewise, when the dispenser 2 needs to be installed in the withdrawal space, the retaining hook 41 is pressed to avoid that the dispenser 2 cannot be installed because the protrusion 411 abuts against an outer end face of the withdrawal port of the detergent container 1. Thus, the limiting device 4 has a simple and reliable structure.

Specifically, when the second spring 43 abuts against the dispenser 2, an inner wall of the groove 224 is provided with a positioning column 2241 configured to position the second spring 43. Therefore, it is advantageous to ensure the pushing action of the second spring 43 on the retaining hook 41, facilitate the installation of the second spring 43, and thereby improve the reliability of the limiting device 4.

Specifically, the part of the retaining hook 41 facing the pressing hole 421 is configured as a pressing portion 412. The second end of the second spring 43 abuts against the pressing portion 412 of the retaining hook 41 to normally push the pressing portion 412 to extend out of the pressing hole 421. Therefore, the structure of the limiting device 4 is simple, the operation is convenient, and the reliability of the limiting device 4 can be ensured. The black arrows in FIGS. 3 and 7 indicate a direction of pressing the pressing portion.

Specifically, the delivery device 100 further includes a handle 5, and the handle 5 is disposed at a side of the dispenser 2 being pulled outwards, which facilitates the withdrawal of the dispenser 2 by the user and upgrades the comfort of the user.

Specifically, the detergent container 1 further includes a water injection port 14 directly in communication with the washtub, so as to shorten the water injection time of the washing machine 200.

The washing machine 200 according to embodiments of the present disclosure includes a cabinet 201, a washtub, and the above delivery device 100.

Specifically, the washtub and the delivery device 100 are disposed in the cabinet 201, and the delivery device 100 is disposed at an upper portion of the washtub and communicated with the washtub. Thus, the delivery of the mixed liquid into the washtub by the delivery device 100 can be facilitated.

For the washing machine 200 according to embodiments of the present disclosure, by providing the delivery device 100 according to the above embodiments of the present disclosure, the storage capacity of the liquid washing products can be increased, and the simultaneous suction of different types of washing products and individual delivery thereof can be realized, in which way the delivery device 100 is formed as an automatic delivery structure, and the user comfort is improved.

The structure of the delivery device 100 according to a specific embodiment of the present disclosure will be described in detail with reference to FIGS. 1-10. It needs to be noted that the following description is only exemplary, and after reading the following technical solutions of the present disclosure, those skilled in the art can combine, replace or modify the technical solutions or some technical features, which also falls within the protection scope claimed by the present disclosure.

As illustrated in FIGS. 1-10, the delivery device 100 according to embodiments of the present disclosure includes a detergent container 1, a dispenser 2, a pump 3, a handle 5, and a limiting device 4.

The detergent container 1 includes an upper cover 11, a middle cover 12, and a lower cover 13. The lower cover 13 defines a withdrawal space having an open top, and is provided with an overall outlet. The middle cover 12 is disposed on top of the lower cover 13, the upper cover 11 is disposed on top of the middle cover 12, and the upper cover 11 and the middle cover 12 define a flow space therebetween. The flow space has a first inlet 121, a second inlet 122, a water inlet 123, and a liquid outlet 124. The liquid outlet 124 is connected with the overall outlet through a pipe, and the overall outlet is configured to be connected with a washtub of the washing machine 200. The flow space is also provided with a unidirectional valve 125 therein, and the unidirectional valve 125 is arranged adjacent to the water inlet 123 and configured to allow the water to unidirectionally flow into the flow space through the water inlet 123. The unidirectional valve 125 includes a second valve body 1251 and a third spring 1252, and the third spring 1252 abuts against the second valve body 1251 and an inner wall of the water flow space to normally abut against the second valve body 1251 to close the water inlet 123. The detergent container 1 also includes a water injection port 14 directly in communication with the washtub.

The dispenser 2 is disposed in the withdrawal space and can be pushed into or pulled out of the withdrawal space, and the handle 5 is provided at a side of the dispenser 2 being pulled outwards. The dispenser 2 includes a dispenser box body 21, a dispenser box lid 22, and two delivery lids 223. The dispenser box body 21 defines two placing cavities 211 spaced apart from each other, and each placing cavity 211 is provided with a delivery opening 221, a floater 23, and a liquid discharge channel. The dispenser box lid 22 is disposed on top of the dispenser box body 21, two delivery openings 221 are provided on the dispenser box lid 22, and the two delivery lids 223 are arranged corresponding to the two delivery openings 221 to open or close the respective delivery openings 221. The dispenser box lid 22 defines a flow channel therein, and the dispenser box lid 22 has a bottom wall provided with two extension pipes 222 extending downwardly. The two extension pipes 222 extend into the two placing cavities 211 respectively, and together with the flow channel define the liquid discharge channels.

The pump 3 includes two inflow openings 31 and two outflow openings 32. The two inflow openings 31 are connected to the dispenser box lid 22 and connected with two liquid discharge channels correspondingly. The two outflow openings 32 are connected with the first inlet 121 and the second inlet 122 respectively.

Each liquid discharge channel is provided with a closure member 225 therein, and the closure member 225 normally closes the liquid discharge channel. The closure member 225 includes an annular sealing member 2251, a first valve body 2252, and a first spring 2253. The sealing member 2251 is disposed in the liquid discharge channel, and has an outer peripheral wall in contact with an inner wall of the liquid discharge channel. The first valve body 2252 is movably disposed in the liquid discharge channel and located inside the sealing member 2251. The first spring 2253 has two ends abutting against an inner wall of the dispenser 2 and the first valve body 2252 respectively, to normally push the first valve body 2252 to cooperate with the sealing member 2251, so as to seal an internal space of the sealing member 2251. The closure member 225 is opened when each inflow opening 31 and the corresponding liquid discharge channel cooperate to suck the liquid.

The limiting device 4 is configured to limit the withdrawal displacement of the dispenser 2. The limiting device 4 includes a retaining hook 41, a hook seat 42, and a second spring 43. The hook seat 42 is disposed in a groove 224 of an outer peripheral wall of the dispenser 2. The groove 224 has an inner wall provided with a positioning column 2241 configured to position the second spring 43. The hook seat 42 is provided with a pressing hole 421 and a protrusion hole 422. The retaining hook 41 is disposed in the hook seat 42, is provided with a protrusion 411 facing the protrusion hole 422, and also has a pressing portion 412 facing the pressing hole 421. The second spring 43 has an end abutting against the pressing portion 412 to normally push the protrusion 411 to extend out of the protrusion hole 422.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Furthermore, the particular features, structures, materials, or characteristics may be combined in any suitable manner in one or more embodiments or examples. Moreover, without contradicting each other, those skilled in the art may incorporate and combine various embodiments or examples, as well as the features of the various embodiments or examples described in this specification.

Although embodiments of the present disclosure have been shown and described, it would be appreciated by those skilled in the art that the above embodiments are exemplary, cannot be interpreted to limit the present disclosure, and any changes, modifications, alternatives, and variants can be made in the embodiments without departing from the scope of the present disclosure.

What is claimed is:

1. A delivery device for a washing machine, comprising:

a detergent container defining a flow space and a withdrawal space therein, the flow space having a first inlet, a second inlet, a water inlet, and a liquid outlet, and the liquid outlet being configured to be connected with a washtub of the washing machine;

a dispenser disposed in the withdrawal space and capable of being pushed into and pulled out of the withdrawal space, and defining two placing cavities spaced apart from each other therein, each placing cavity having a delivery opening and a liquid discharge channel, wherein each liquid discharge channel is provided with a closure member therein, the closure member comprising an annular sealing member, a first valve body, and a first spring, and the first spring has two ends abutting an inner wall of the dispenser and the first valve body respectively that normally push the first valve body to cooperate with the sealing member to seal an internal space of the sealing member; and a pump comprising two inflow openings connected with the two liquid discharge channels respectively, and two outflow openings connected with the first inlet and the second inlet respectively, wherein each inflow opening passes through the sealing member to be communicated with each corresponding liquid discharge channel.

2. The delivery device according to claim 1, wherein the closure member normally closes the liquid discharge channel, and the closure member is opened when each of the inflow openings and the corresponding liquid discharge channel cooperate to suck liquid.

3. The delivery device according to claim 2, wherein the sealing member is disposed in the liquid discharge channel, and has an outer peripheral wall in contact with an inner wall of the liquid discharge channel; the first valve body is movably disposed in the liquid discharge channel and located inside the sealing member.

4. The delivery device according to claim 1, further comprising a limiting device configured to limit withdrawal displacement of the dispenser.

5. The delivery device according to claim 4, wherein the limiting device comprises a retaining hook, a hook seat, and a second spring; the hook seat is disposed in a groove of an outer peripheral wall of the dispenser and provided with a pressing hole and a protrusion hole; the retaining hook is disposed in the hook seat, is provided with a protrusion facing the protrusion hole, and has a part facing the pressing hole; the second spring has a first end abutting the dispenser, and a second end abutting the retaining hook to normally push the protrusion to extend out of the protrusion hole.

6. The delivery device according to claim 5, wherein when the second spring abuts the dispenser, the groove has an inner wall provided with a positioning column configured to position the second spring.

7. The delivery device according to claim 1, wherein the dispenser further comprises two delivery lids arranged corresponding to the two delivery openings to open or close the two delivery openings respectively.

8. The delivery device according to claim 1, wherein the flow space is provided with a unidirectional valve therein, and the unidirectional valve is arranged adjacent to the water inlet and configured to allow water to unidirectionally flow into the flow space through the water inlet.

9. The delivery device according to claim 8, wherein the unidirectional valve comprises a second valve body and a third spring, and the third spring abuts the second valve body and an inner wall of the flow space to normally push the second valve body to close the water inlet.

10. The delivery device according to claim 1, wherein the detergent container comprises an upper cover, a middle cover, and a lower cover; the lower cover defines the withdrawal space with an open top, and is provided with an overall outlet; the middle cover is disposed on top of the lower cover, the upper cover is disposed on top of the middle cover, and the upper cover and the middle cover define the flow space therebetween.

11. The delivery device according to claim 1, wherein the dispenser comprises a dispenser box body and a dispenser box lid; the dispenser box body defines the two placing cavities therein; and the dispenser box lid is disposed on top of the dispenser box body and provided with the two delivery openings therein.

12. The delivery device according to claim 11, wherein the dispenser box lid is provided with two flow channels therein, and has a bottom wall provided with two extension pipes extending downwardly; the two extension pipes extend into the two placing cavities respectively, and together with the flow channels define the liquid discharge channels;

and the two inflow openings are connected to the dispenser box lid.

13. A washing machine, comprising:

a delivery device that includes:

a detergent container defining a flow space and a withdrawal space therein, the flow space having a first inlet, a second inlet, a water inlet, and a liquid outlet, and the liquid outlet being configured to be connected with a washtub of the washing machine;

a dispenser disposed in the withdrawal space and capable of being pushed into and pulled out of the withdrawal space, and defining two placing cavities spaced apart from each other therein, each placing cavity having a delivery opening and a liquid discharge channel, wherein each liquid discharge channel is provided with a closure member therein, the closure member comprising an annular sealing member, a first valve body, and a first spring, and the first spring has two ends abutting an inner wall of the dispenser and the first valve body respectively that normally push the first valve body to cooperate with the sealing member to seal an internal space of the sealing member; and a pump comprising two inflow openings connected with the two liquid discharge channels respectively, and two outflow openings connected with the first inlet and the second inlet respectively, wherein each inflow opening passes through the sealing member to be communicated with each corresponding liquid discharge channel.

* * * * *